US007946063B2

(12) United States Patent
Paull

(10) Patent No.: US 7,946,063 B2
(45) Date of Patent: May 24, 2011

(54) ATTACHMENT SYSTEM AND LEVELER ATTACHMENT FOR A MECHANICAL HOE

(76) Inventor: Philip Paull, Noblesville, IN (US)

( * ) Notice: Subject to any disclaimer, the term of this patent is extended or adjusted under 35 U.S.C. 154(b) by 0 days.

(21) Appl. No.: 12/909,430

(22) Filed: Oct. 21, 2010

(65) Prior Publication Data

US 2011/0088920 A1 Apr. 21, 2011

Related U.S. Application Data

(60) Provisional application No. 61/253,834, filed on Oct. 21, 2009.

(51) Int. Cl.
*E02F 3/76* (2006.01)
*E01C 19/22* (2006.01)

(52) U.S. Cl. ..... 37/407; 404/118

(58) Field of Classification Search ..... 37/403–409, 37/468, 301, 455, 450, 903, 444, 367, 370, 37/380, 449; 172/810–815, 817, 834; 404/118, 404/120, 106, 83, 103, 109, 72, 75, 84.5, 404/84.05, 84.1; 405/47, 50, 179
See application file for complete search history.

(56) References Cited

U.S. PATENT DOCUMENTS 3,664,137 A * 5/1972 Lett ..... 405/50
4,322,178 A * 3/1982 Lee ..... 404/83
5,273,375 A * 12/1993 Plourde ..... 404/118
5,806,607 A * 9/1998 Sanders ..... 172/253
6,447,204 B1 * 9/2002 McDonald ..... 404/118
6,530,721 B2 * 3/2003 Yost ..... 404/84.5
6,729,796 B1 * 5/2004 Green ..... 404/84.5
7,311,466 B2 * 12/2007 Torvinen ..... 404/118
7,506,462 B2 * 3/2009 Reid ..... 37/409
7,581,340 B2 * 9/2009 Wolfe ..... 37/407

* cited by examiner

*Primary Examiner* — Robert E Pezzuto
(74) *Attorney, Agent, or Firm* — C. John Brannon; Brannon Sowers Hughel PC

(57) ABSTRACT

A screed assembly for attachment to the boom arm of a mechanical hoe, including a first elongated member, an elongated ground-engaging structural member extending therefrom, a hoe connection interface and a hydraulic boom connection interface on the first elongated member, and a blade-engaging assembly operationally connected to the first elongated member. An elongated blade portion is pivotably connected to the blade-engaging assembly, a first pivot actuator is operationally connected between the first generally elongated portion and to the blade-engaging assembly, and a second pivot actuator operationally connected to the blade-engaging assembly and the elongated blade portion. Energization of the first pivot actuator pivots the blade engaging assembly relative to the first elongated member and energization of the second pivot actuator pivots the blade relative to the blade-engaging assembly.

13 Claims, 10 Drawing Sheets

ATTACHMENT SYSTEM AND LEVELER ATTACHMENT FOR A MECHANICAL HOE

CROSS-REFERENCE TO RELATED APPLICATIONS

This patent application claims priority to co-pending U.S. Provisional Patent Application Ser. No. 61/253,834, filed on Oct. 21, 2009.

TECHNICAL FIELD

The present novel technology relates generally to the field of mechanical engineering, and, more particularly, to an attachment apparatus for enabling a track hoe to perform leveling operations and a method for using the same.

BACKGROUND

The track hoe is an extremely versatile digging and earthmoving tool. Track hoes can be maneuvered into position for working in places where other earthmoving machinery cannot maneuver. The characteristic apparatus of the track hoe is a hinged and hydraulically driven armature to which a digging apparatus, such as a bucket, may be connected. Other apparati connectible to the hoe armature include jack hammers, tampers, and the like.

One task that has thus far eluded the capabilities of the track hoe is that of precision leveling or grading. Typically, the bulldozer is the machine of choice for grading and leveling earth, and is fine for leveling or grading large stretches of relatively flat, open ground. However, the bulldozer is less appealing for grading smaller plots that may be situated in hard-to-reach areas, such as narrow terraces or the like. Further, bulldozers cannot be used to grade and level areas that cannot support their weight. Moreover, geographical and/or landscaping concerns may prevent a bulldozer from getting to areas where it otherwise might be free to function. While such concerns do not prevent manual grading with hand tools, such efforts are time and labor intensive and, thus, inefficient.

Thus, there is a need for an apparatus that would take advantage of the versatility of a track hoe system for grading and leveling small plots, hard-to-reach sections of land, and/or areas that cannot support the weight of a bulldozer. The present novel technology addresses this need.

SUMMARY

The present novel technology relates to a method and apparatus for leveling and grading using a track hoe. One object of the present novel technology is to provide an improved track hoe attachment system allowing use of a leveling and grading attachment. Related objects and advantages of the present novel technology will be apparent from the following description.

DETAILED DESCRIPTION OF THE PREFERRED EMBODIMENT

Figure 1:
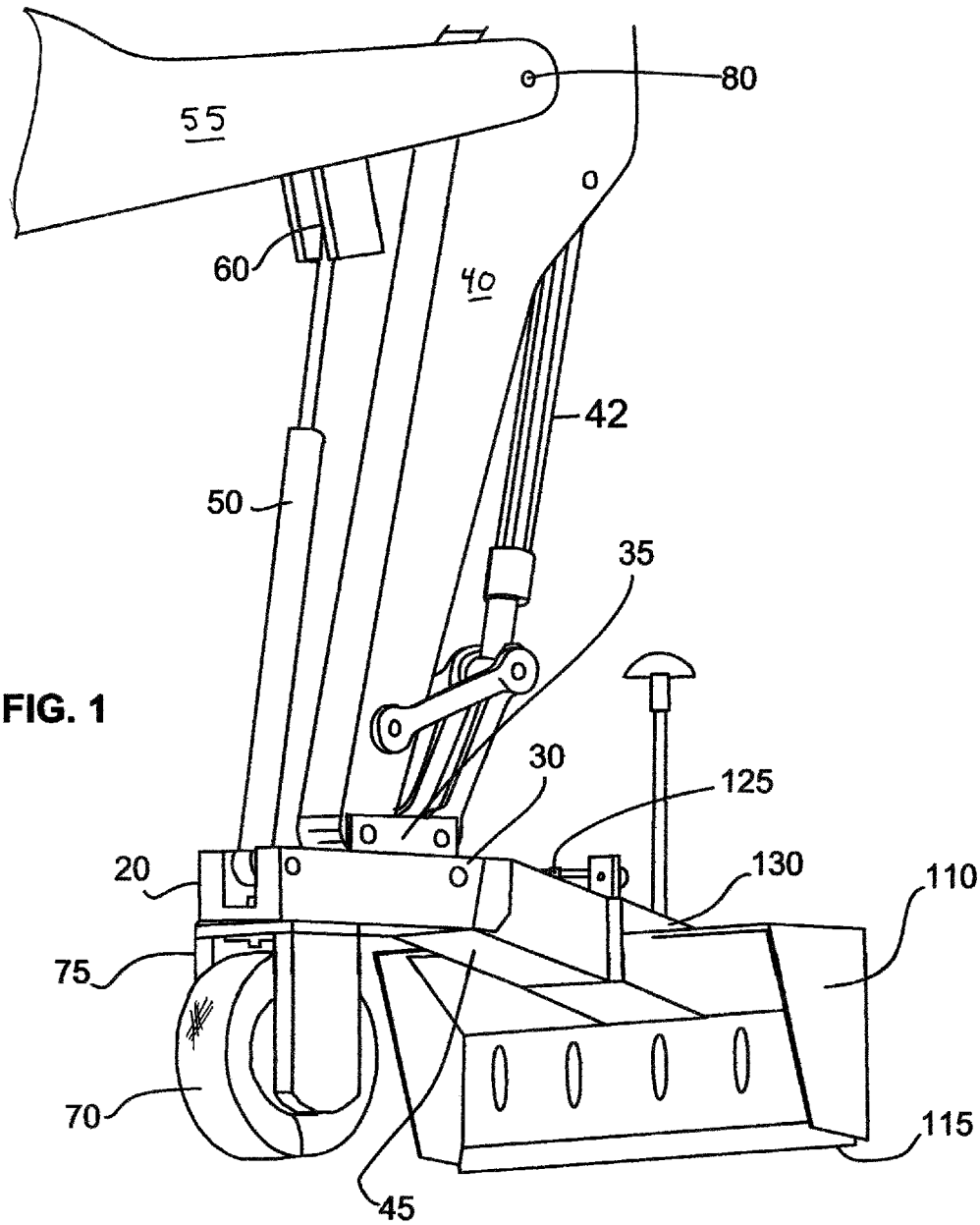
FIG. 1 is a first perspective view of a leveler attachment for a mechanical hoe according to a first embodiment of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

A typical back hoe, track hoe or like excavator includes a hinged armature or boom having a connection plate or assembly at the far end. The connection assembly typically includes one or more connection members and a set of pins for engaging an attachment, typically a bucket. The connection members and pins are typically more than twelve inches long.

The present novel technology allows for the grading and/or leveling of plots that are difficult to reach or otherwise awkwardly positioned, as well as for grading and leveling of earth, wet concrete, gravel and the like using a track hoe for a much faster, more efficient grading/leveling technique. A first embodiment of the present novel technology is illustrated in FIGS. 1-4C, a track hoe attachment system 10 including a leveling blade attachment 15 for grading and leveling worksites. The system 10 includes a first elongated structural member 20 hingedly or pivotably connected to a second elongated structural member 25 by pin 30. An armature connection member 35 is connected to the top surface of the first elongated support member 20 for connecting to a track hoe armature 40, such as via pins 45. A hydraulic boom connection member 50 extends between the track hoe boom 55 and the first elongated structural member 20, pivotably connecting to the boom 55 at boom connection member 60 and pivotably connecting to the first elongated support member 20 at second or rear pin 65. Typically castor wheel 70 is pivotably connected to first elongated support member 20 by pin 75, although in some embodiments, skid assembly 71 may extend from elongated support member (see FIGS. 4 and 5). Boom 55 is connected to armature 40 by pin 80.

In this particular embodiment, stability and control is enhanced by the geometry of the system 10. A line drawn between pins 60 and 80 would remain generally parallel with a line drawn between pins 45 and 65. The axes of the generally cylindrical hydraulic boom member 50 and the boom arm 40 likewise remain generally parallel, such that these four lines intersect to approximate a parallelogram. While the geometry of a parallelogram (or a substantial parallelogram) offers greater control of system 10, other embodiments may be made having differing geometry.

Figure 6:
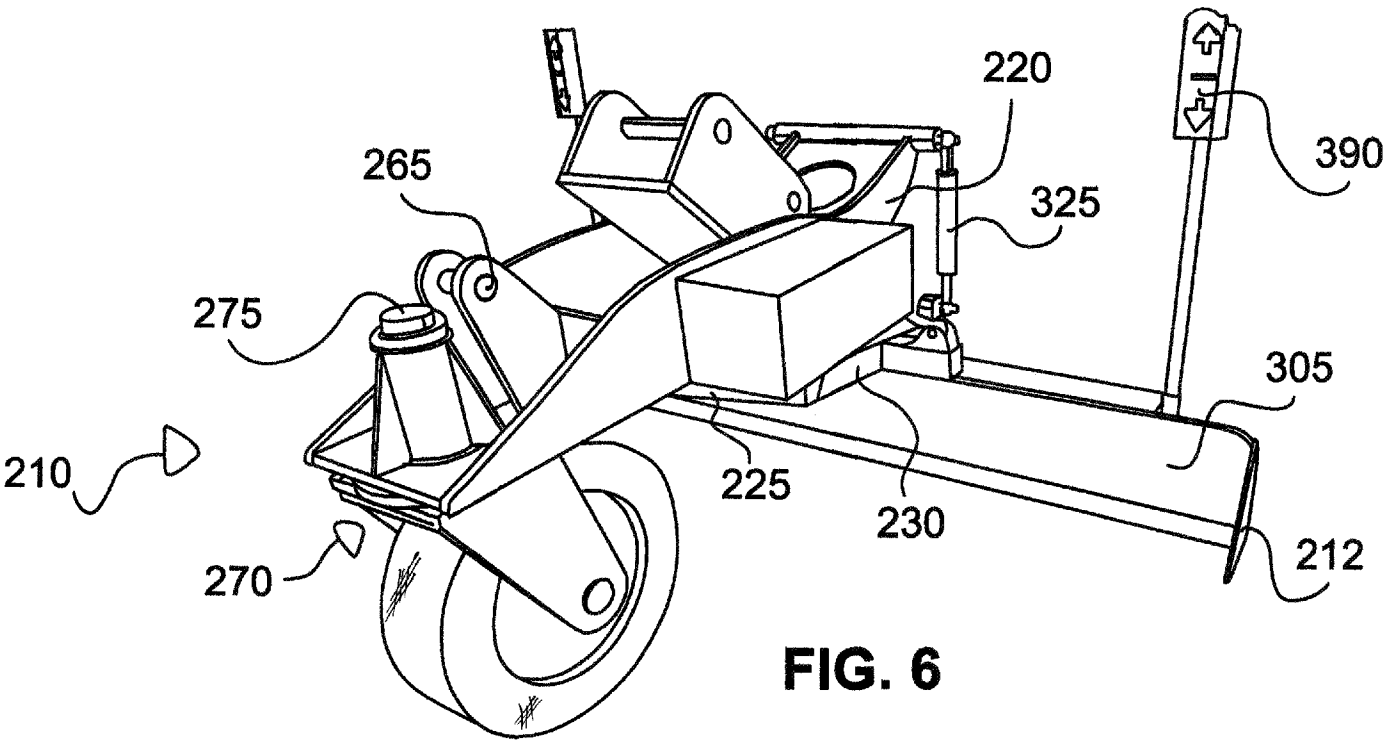
FIG. 6 is a second perspective view of the embodiment of FIG. 5.
Figure 7:
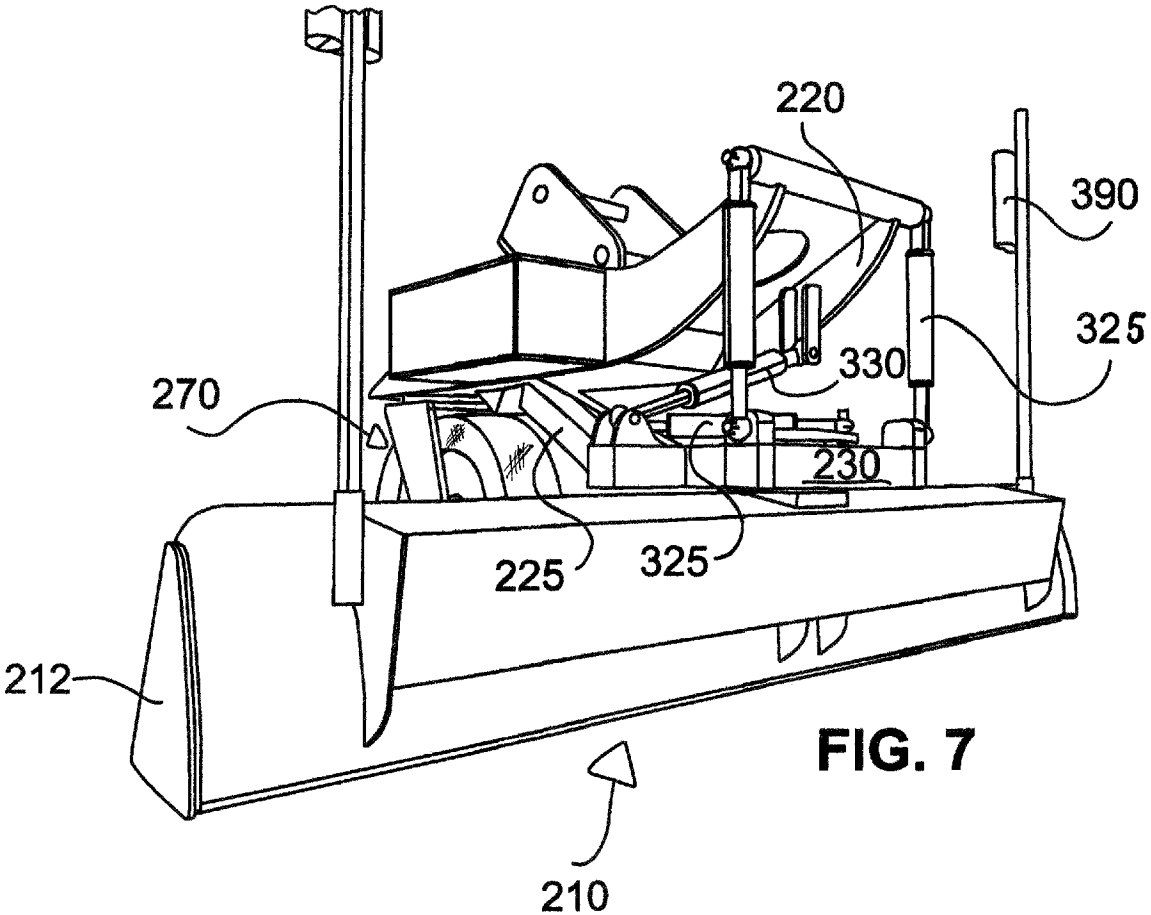
FIG. 7 is a third perspective view of the embodiment of FIG. 5.
Figure 8:
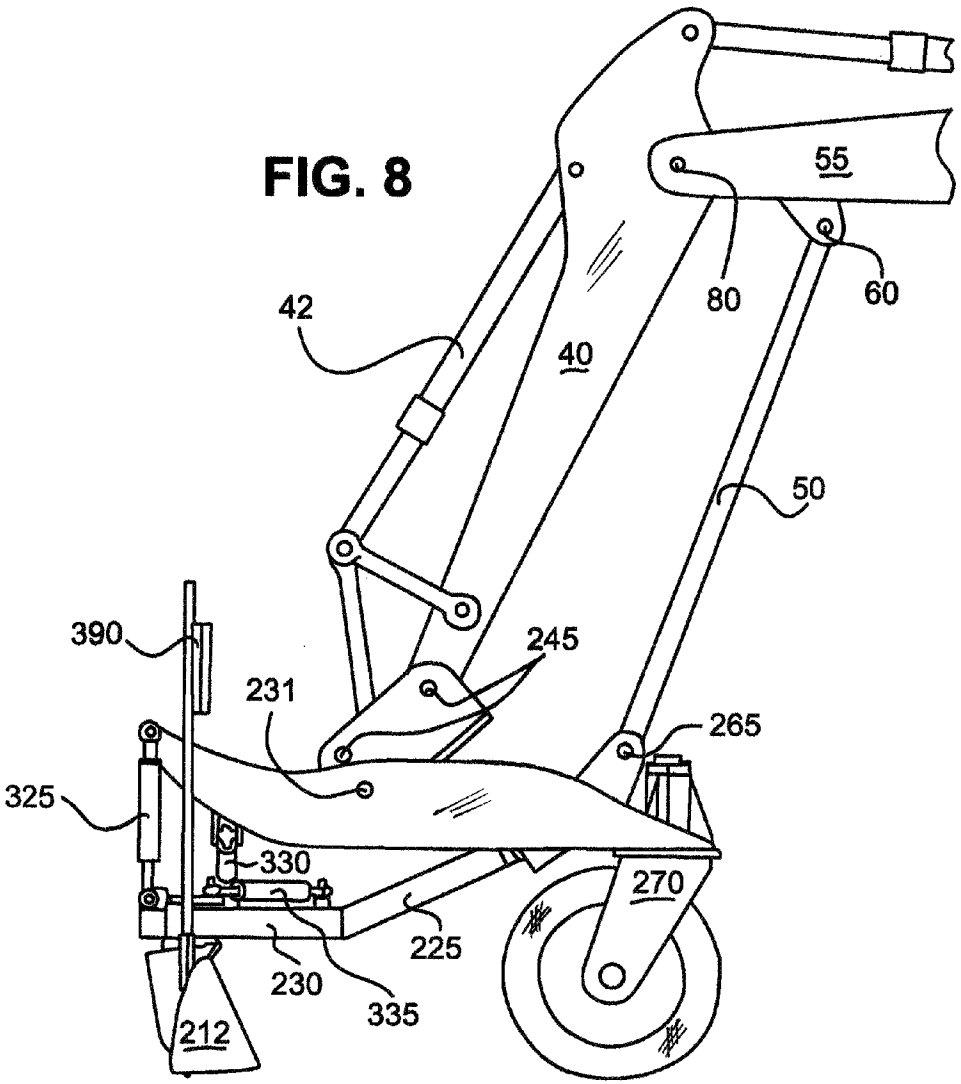
FIG. 8 is a first side elevation view of the embodiment of FIG. 5 as attached to a mechanical hoe boom arm.

In this particular embodiment, blade assembly 100 is operationally connected to track hoe attachment system 10. Blade assembly 100 includes an elongated, generally flat front member 105, typically having opposing sidewalls 110 extending therefrom. Finishing blade 115 extends downwardly from front member 105. Blade assembly 100 further includes a hydraulic cylinder 125 operationally connected at one end to the second elongated structural member 25 and at the other end to a third elongated structural member 130. Third elongated structural member 130 is pivotably connected to second elongated structural member 25 (such as, in this embodiment, by pin 135), such that actuation of the hydraulic cylinder 125 urges the third elongated structural member 130 and, by extension, the generally flat member 105 connected thereto, to pivot about pin 135 (see FIGS. 6 and 7). Typically, the generally flat front member 105 includes several apertures 145 formed therethrough, to provide viewing ports for the operator.

Figure 2:
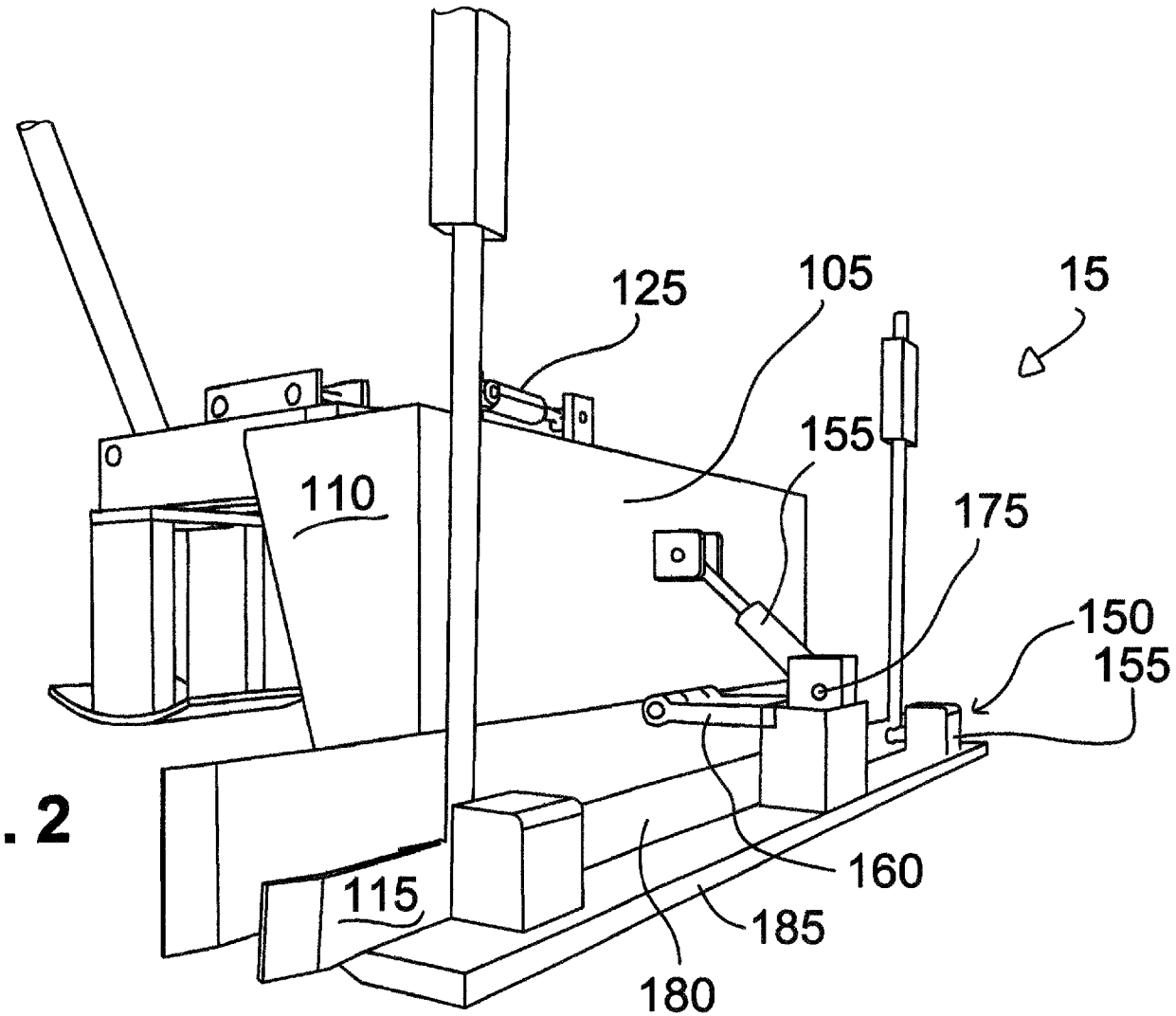
FIG. 2 is a second perspective view of the embodiment of FIG. 1.
Figure 3:
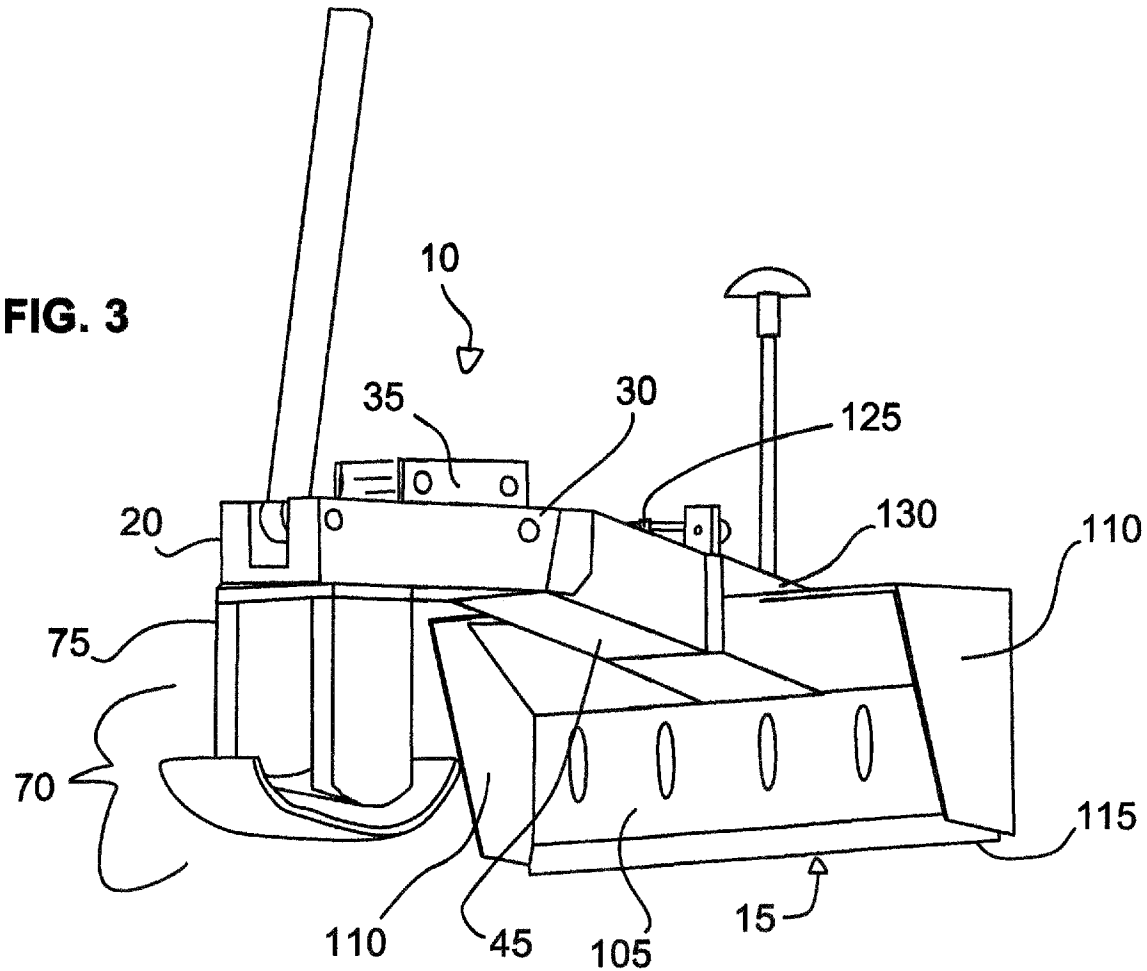
FIG. 3 is a third perspective view of the embodiment of FIG. 1.

FIG. 2 illustrates in greater detail laser or GPS enabled screed attachment assembly 150 connected to blade assembly 100 for precision grading, leveling and/or screeding. Screed assembly 150 is typically pivotably connected to generally flat member 105 and includes connection portion 155 pivotably connected to flat member 105 by connection member 160 and also connected to flat member 105 by hydraulic cylinder 165. Connection member 160 is pivotably connected to the flat member 105 by pin 170. Hydraulic cylinder 165 is pivotably connected to connection portion 155 by pin 175. Connection portion is connected to secondary finishing blade 180 and to screed 185. Actuation of hydraulic cylinder 165 urges the screed assembly 150 to pivot up and toward the flat member 105 when not in use. When in use for screeding concrete or the like, the assembly 150 is pivoted forward such that the screed is generally parallel to the material desired to be screeded and essentially perpendicular to the flat member 105. The hydraulic cylinder 165 is typically allowed to "float".

Figure 4A:
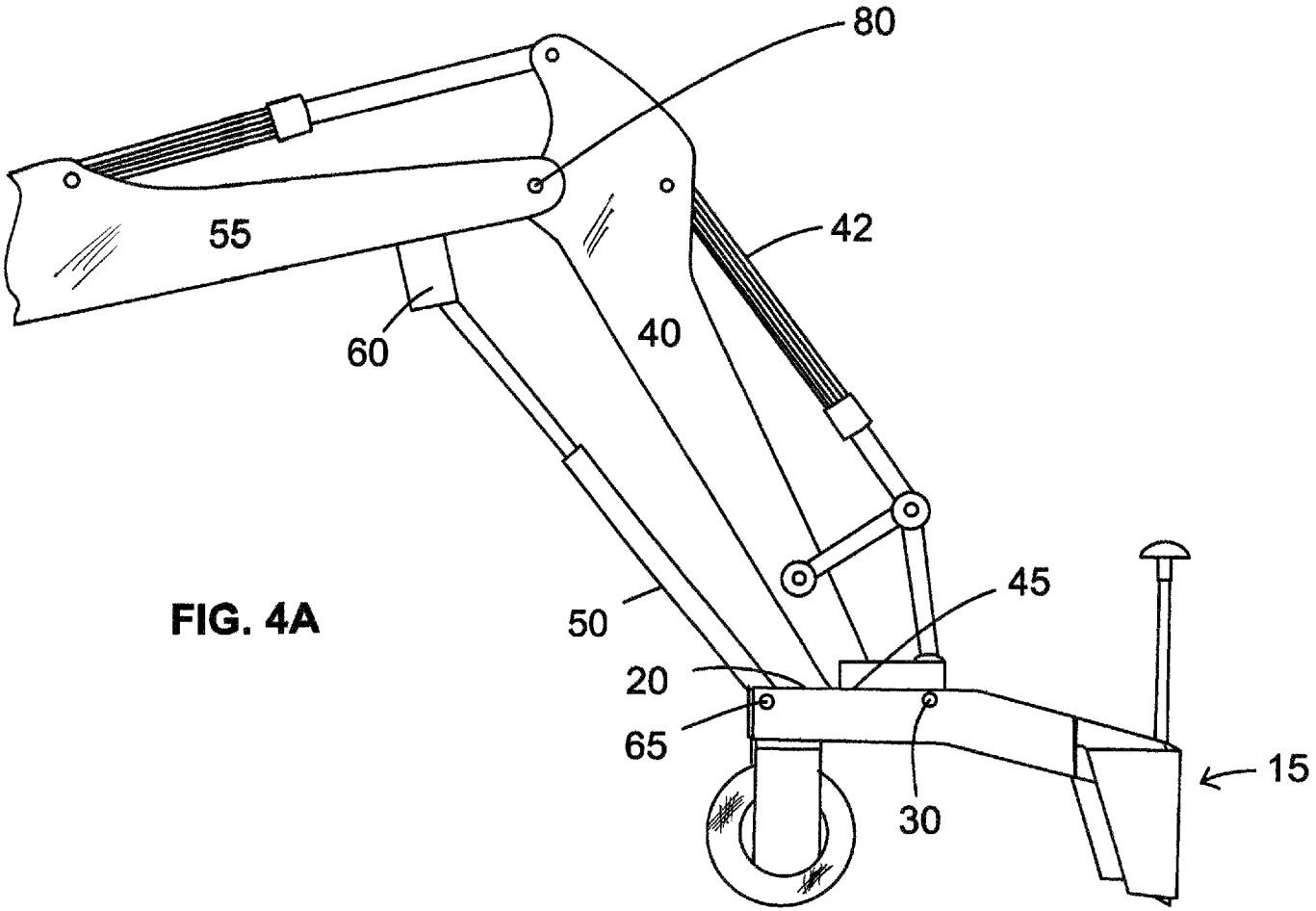
FIG. 4A is a first side elevation view of the embodiment of FIG. 1 as attached to a mechanical hoe boom arm in an extended position.
Figure 4B:
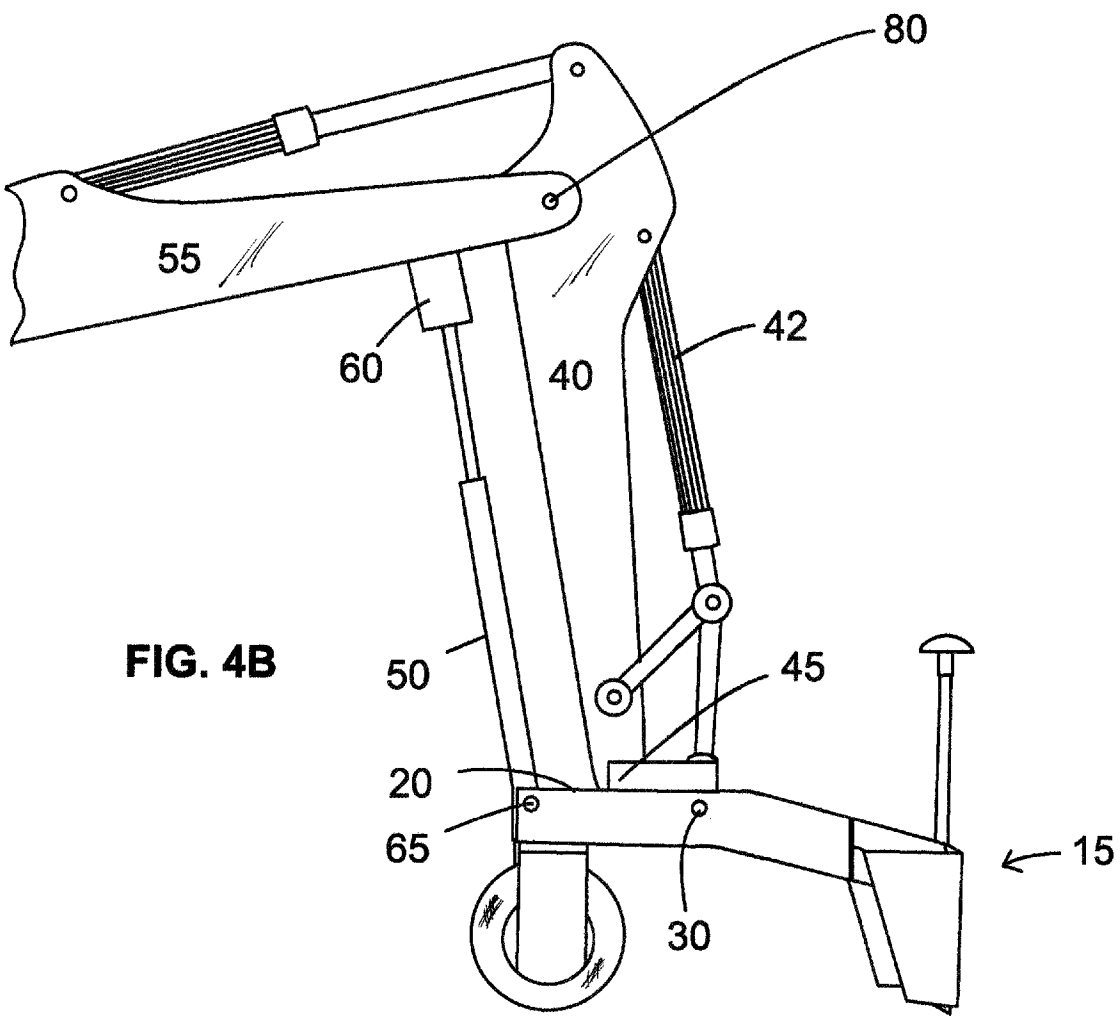
FIG. 4B is a second side elevation view of the embodiment of FIG. 1 as attached to a mechanical hoe boom arm in an partially extended position.
Figure 4C:
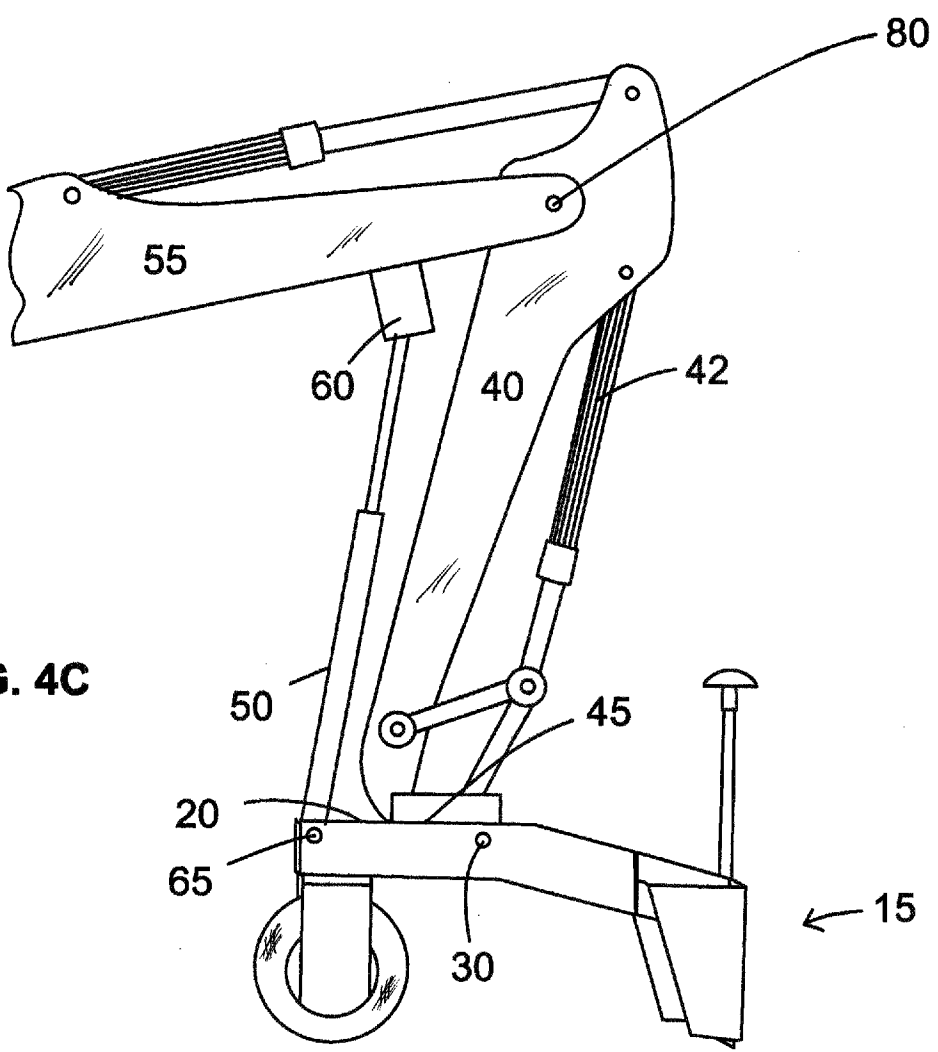
FIG. 4C is a third side elevation view of the embodiment of FIG. 1 as attached to a mechanical hoe boom arm in a retracted position.
Figure 5:
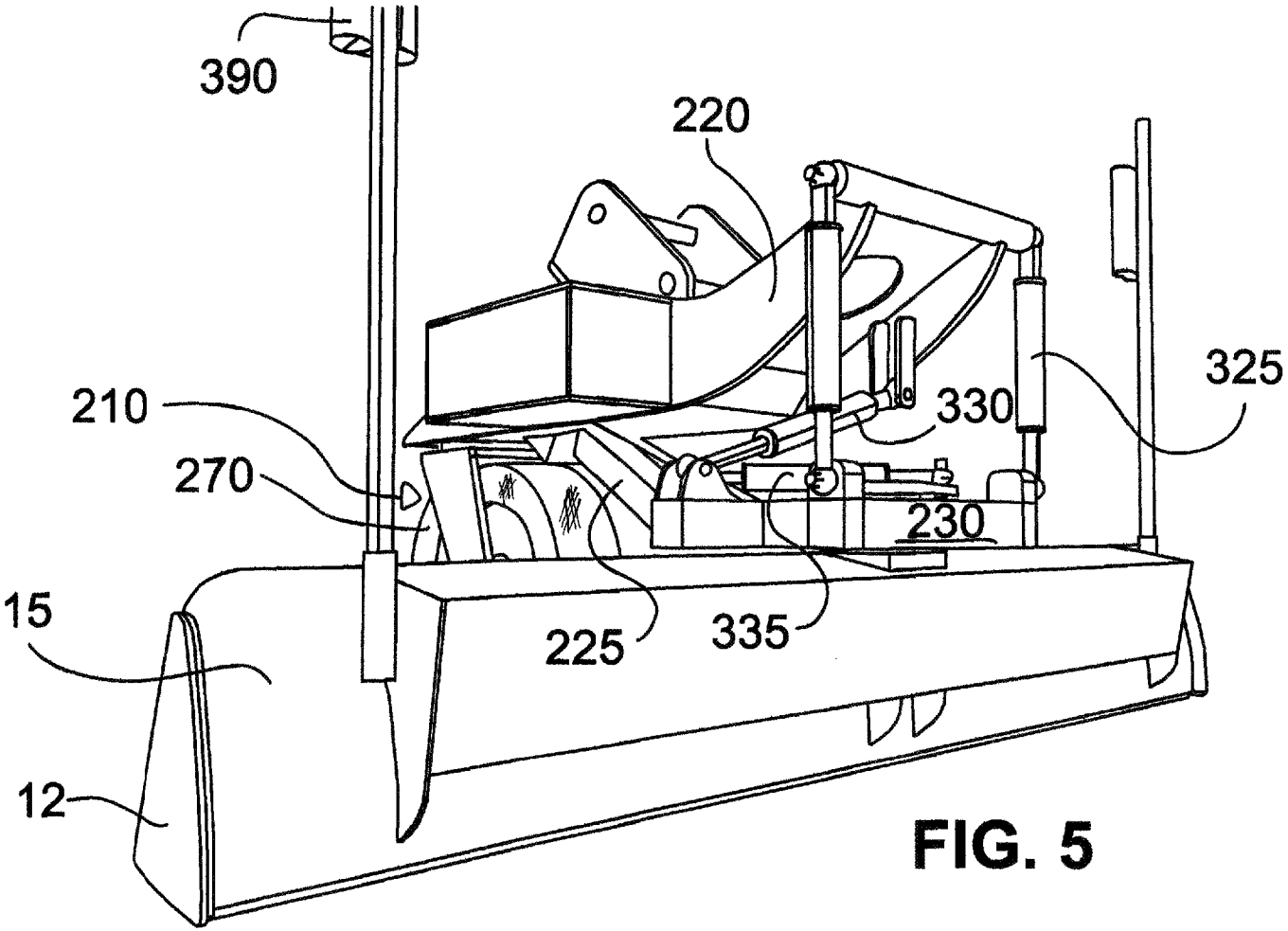
FIG. 5 is a first perspective view of a leveler attachment for a mechanical hoe according to a second embodiment of the present novel technology.

As shown in FIGS. 4A-4C, the blade assembly 100 is moved back and forth via pivoting the armature 40 relative to the boom 55, which remains generally fixed. During horizontal movement, of the blade assembly 100, the hydraulic boom connection member 50 and the hydraulic bucket actuation member 42 generally remain about the same length while the first elongated support member 20 remains generally parallel to a line drawn between the boom connection pin 60 and the boom-armature connecting pin 80. This is because the distance between the connection pin 60 and the boom-armature connecting pin 80 is substantially equal to the distance between the distance between the rear castor pin 65 and the forward pin 30.

FIGS. 5-8 illustrate a second embodiment of the present novel technology, an assembly 210 including a generally elongated and generally flat leveling blade 215 for grading and leveling worksites. The blade 215 typically includes sidewall portions 212. The system 210 includes a first elongated structural member 220 hingedly or pivotably connected to a blade-engaging assembly 217. Blade-engaging assembly typically further includes second elongated structural member 225, which is typically pivotably connected to structural member 220 at one end and fixedly connected to third elongated structural member 230 at the other end. An armature connection interface 235 is connected to the top surface of the first elongated support member 220 for connecting to a track hoe armature 40, such as via pin(s) 245. A hydraulic boom 50 extends between the track hoe boom 55 and the first elongated structural member 220, pivotably connecting to the boom 55 at boom connection pin 60 and pivotably connecting to the first elongated support member 220 at hydraulic boom connection interface or rear pin 265. Typically, a ground engaging member 270, such as a skid or castor wheel, is pivotably connected to first elongated support member 220, such as by pin 275. Boom 55 is connected to armature 40 by pin 80.

Typically, at least one, and more typically two, motion dampeners 325 are connected between the front portion of the first elongated member 220 and the front portion of the blade-engaging assembly 217 (typically the front portion of member 230). Dampeners 325 are typically hydraulic cylinders, which also can act as pivoting actuators to pivot assembly 217 and blade 215 down and away from/up and towards member 220, i.e., around an axis generally perpendicular to the major axis of the first elongated member 220 and generally horizontal.

Pivoting actuation member 330 is connected between the first elongated member 220 and the front portion of the blade-engaging assembly 217 (typically the front portion of member 230). Pivoting actuation member 330 is typically a hydraulic cylinder or the like, and may be energized to pivot assembly 217 and blade 215 such that one end of blade 215 moves down and away from member 220 while the other end moves up and towards member 220, i.e., around an axis generally parallel to the major axis of the first elongated member 220 and generally horizontal. Pivoting actuator 335 is connected between pivot assembly 217 and blade 215 and may be energized to pivot blade 215 around an axis generally perpendicular to the axis of the first elongated member 220 and generally vertical.

Typically, the hydraulic actuators 325, 330, 335 are supplied by the hydraulic system of the mechanical hoe to which the system 210 is connected. The system 210 is typically supplied with a set of valves for receiving, redirecting and regulating the flow of pressurized hydraulic fluid (not shown).

Guidance portion 390 is operationally connected to blade 215. Guidance portion is typically a laser target, a GPS transceiver, or the like. Guidance portion 390 is typically configured to communicate electrically or electronically with the microprocessor or electronic controller assembly operationally connected to the mechanical hoe (such as by a hardwired or radio frequency (RF) connection).

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A leveling and grading assembly for attachment to a boom arm of a track hoe, comprising:

a first elongated structural member;

an armature connection interface connected to the first elongated structural member;

a hydraulic boom connection interface connected to the first elongated structural member;

a second elongated structural member pivotably connected to the first elongated structural member;

a third elongated structural member pivotably connected to the second elongated structural member;

a hydraulic cylinder connected at one end to the second elongated structural member and at the opposite end to the third elongated structural member;

a grading blade operationally connected to the third elongated structural member;

a screed assembly pivotably connected to the grading blade;

wherein the screed assembly further comprises:

a structural portion pivotably connected to the grading blade;

a guidance portion connected to the structural portion;

an actuator portion operationally connected to the structural portion;

a generally flat screed connected to the structural portion;

wherein the actuator portion may be energized to pivot the structural portion and the screed between a screeding position with the screed pivoted away from the grading blade and a standby position with the screed pivoted toward the grading blade;

wherein the guidance portion is actuatable to query a reference point and electronically communicate with a track hoe control system.

2. The leveling and grading assembly of claim 1 and further comprising a secondary finishing blade operationally connected to the third structural member.

3. The leveling and grading assembly of claim 1 and further comprising a ground-engaging member extending from the first elongated member.

4. A screed assembly for attachment to a boom arm of a mechanical hoe, comprising:

a first generally elongated member;

an elongated ground-engaging structural member extending from the first generally elongated portion;

a hoe connection interface coupled to the first generally elongated portion;

a hydraulic boom connection interface coupled to the first generally elongated portion and spaced from the hoe connection interface;

a blade-engaging assembly operationally connected to the first generally elongated member, wherein the blade-engaging assembly further comprises:

a second generally elongated portion pivotably connected to the first generally elongated portion; and a third generally elongated portion connected to the second generally elongated portion;

an elongated blade portion pivotably connected to the blade-engaging assembly;

a first pivot actuator operationally connected between the first generally elongated portion and to the blade-engaging assembly; and a second pivot actuator operationally connected to the blade-engaging assembly and to the elongated blade portion;

wherein energization of the first pivot actuator pivots the blade engaging assembly relative to the first generally elongated member; and wherein energization of the second pivot actuator pivots the blade relative to the blade-engaging assembly.

5. The screed assembly of claim 4 and further comprising a guidance portion operationally connected to the elongated blade portion.

6. The screed assembly of claim 5 wherein the guidance portion is a GPS transceiver.

7. The screed assembly of claim 5 wherein the guidance portion is a laser sensor.

8. The screed assembly of claim 4 and further comprising a third pivot actuator operationally connected to the first generally elongated portion and to the third generally elongated portion.

9. The screed assembly of claim 4 wherein the elongated ground-engaging structural member is a caster wheel.

10. The screed assembly of claim 4 wherein the hoe connection interface includes a first pin for pivotable connection to a mechanical hoe boom arm; wherein the hydraulic boom connection interface includes a second pin for pivotable connection to a mechanical hoe hydraulic boom arm; wherein the mechanical hoe boom arm is pivotably connected to the mechanical hoe by a third pin; wherein the mechanical hoe hydraulic boom arm is pivotably connected to the mechanical hoe by a fourth pin; and wherein a line drawn through the first and second pins is generally parallel to a line drawn through the third and fourth pins.

11. A method of grading and leveling terrain, comprising:

a) connecting a blade attachment to a boom arm of a mechanical hoe, wherein the blade attachment further comprises:

a first generally elongated structural portion;

a blade-engaging assembly pivotably connected to the first generally elongated portion;

an elongated blade portion pivotably connected to the blade-engaging assembly;

a first pivot actuator operationally connected between the first generally elongated portion and to the blade-engaging assembly; and a second pivot actuator operationally connected to the blade-engaging assembly and to the elongated blade portion;

b) engaging the elongated blade portion with terrain desired to be graded;

c) pivoting the elongated blade portion; and d) grading the terrain.

12. The method of claim 11 wherein the blade attachment further comprises:

an elongated ground-engaging structural member extending from the first generally elongated portion.

13. The method of claim 11 wherein the blade attachment further comprises:

a hoe connection interface coupled to the first generally elongated portion; and a hydraulic boom connection interface coupled to the first generally elongated portion and spaced from the hoe connection interface; and wherein the hoe connection interface includes a first pin for pivotable connection to a mechanical hoe boom arm;

wherein the hydraulic boom connection interface includes a second pin for pivotable connection to a mechanical hoe hydraulic boom arm;

wherein the mechanical hoe boom arm is pivotably connected to the mechanical hoe by a third pin;

wherein the mechanical hoe hydraulic boom arm is pivotably connected to the mechanical hoe by a fourth pin; and wherein a line drawn through the first and second pins is generally parallel to a line drawn through the third and fourth pins.

* * * * *